United States Patent [19]

Lefevre

[11] 4,451,411

[45] May 29, 1984

[54] SUPPORT MEANS FOR TRANSVERSE FILL FOR COOLING TOWERS

[75] Inventor: Marcel R. Lefevre, Somerville, N.J.

[73] Assignee: Research-Cottrell, Somerville, N.J.

[21] Appl. No.: 426,062

[22] Filed: Sep. 28, 1982

[51] Int. Cl.[3] ..... B01F 3/04

[52] U.S. Cl. ..... 261/111; 248/544; 261/DIG. 11

[58] Field of Search ..... 261/111, DIG. 11, 112; 248/544, 56, 67.7

[56] References Cited

U.S. PATENT DOCUMENTS

| | | | |
|---|---|---|---|
| 2,306,047 | 12/1942 | Elmer | 261/DIG. 11 |
| 3,643,931 | 2/1972 | Henning et al. | 261/DIG. 11 |
| 3,749,381 | 7/1973 | Furlong et al. | 261/DIG. 11 |
| 3,751,017 | 8/1973 | Lemmens | 261/111 |
| 4,115,484 | 9/1978 | Saxton | 261/DIG. 11 |
| 4,178,333 | 12/1979 | Shepherd | 261/DIG. 11 |
| 4,181,692 | 1/1980 | Stone | 261/DIG. 11 |

*Primary Examiner*—Richard L. Chiesa

*Attorney, Agent, or Firm*—Kerkam, Stowell, Kondracki & Clarke

[57] ABSTRACT

Improved support means are disclosed for a plurality of vertically arranged transversely oriented fill sheets or grids for direct contact cooling towers.

6 Claims, 11 Drawing Figures

SUPPORT MEANS FOR TRANSVERSE FILL FOR COOLING TOWERS

TECHNICAL FIELD

This invention relates to improved support means for vertically stacked transversely oriented fill sheets or grids for direct contact cooling towers, wherein the liquid to be cooled flows downwardly within the tower over a grid or lattice structure and wherein there is an upward and/or transverse movement of an airstream which removes heat from the generally downwardly moving liquid.

BACKGROUND OF THE PRIOR ART

Heat transfer apparatus of the direct liquid/gas type is disclosed in U.S. Pat. No. 3,751,017 Lemmens, wherein the cooling tower includes a plurality of vertically stacked transversely oriented grids or lattices upon which the liquid is downwardly sprayed and the falling liquid is brought into contact with atmospheric air moving generally upwardly through the tower containing the fill or lattices. In this patent at least the corners of each of the lattices are carried on a spider or bracket having a central aperture through which is strung a flexible, preferably stainless steel member and between each vertically tiered bracket is provided a spacer tube which in the preferred embodiment of the Lemmens patent is made of plastic such as PVC. This means of supporting and spacing the lattices has proved to be very effective; however, since all of the brackets and spacers are threaded on steel wire, if one bracket breaks, or if a spacer breaks, or if a lattice breaks, it is very difficult to replace the spacer or the bracket or the lattice in the cooling tower.

BRIEF SUMMARY OF THE INVENTION

The present invention is directed to an improved support means or bracket for the transverse fill for cooling towers which eliminates the need for tubular spacers and materially simplifies initial assembly and replacement of the support brackets and fill without increasing cost of the production of the brackets themselves.

The invention may be generally defined as a liquid cooling tower construction consisting of a housing having a lower air inlet and an upper air outlet, an array of vertically stacked horizontally positioned fill sheets within the housing between the lower air inlet and the upper air outlet, including means for supporting the array of fill sheets in their vertically stacked arrangement comprising fill sheet support bracket means having at least a pair of arms, each of the arms being provided with means engageable with a fill sheet and an opening through each bracket between the means engagable with the fill sheet. Each of the openings through the bracket has at least one recess at the lower end thereof and a slot communicating with the opening and communicating with an outer wall of the bracket. The assembly further includes an elongate hanger member having a diameter less than the width of the slot in the bracket and an enlarged member on the hanger which is receivable in the at least one recess in the bracket.

BRIEF DESCRIPTION OF THE DRAWING

The invention will be more particularly described in reference to the accompanying drawings wherein.

DETAILED DESCRIPTION OF THE INVENTION

Figure 1:
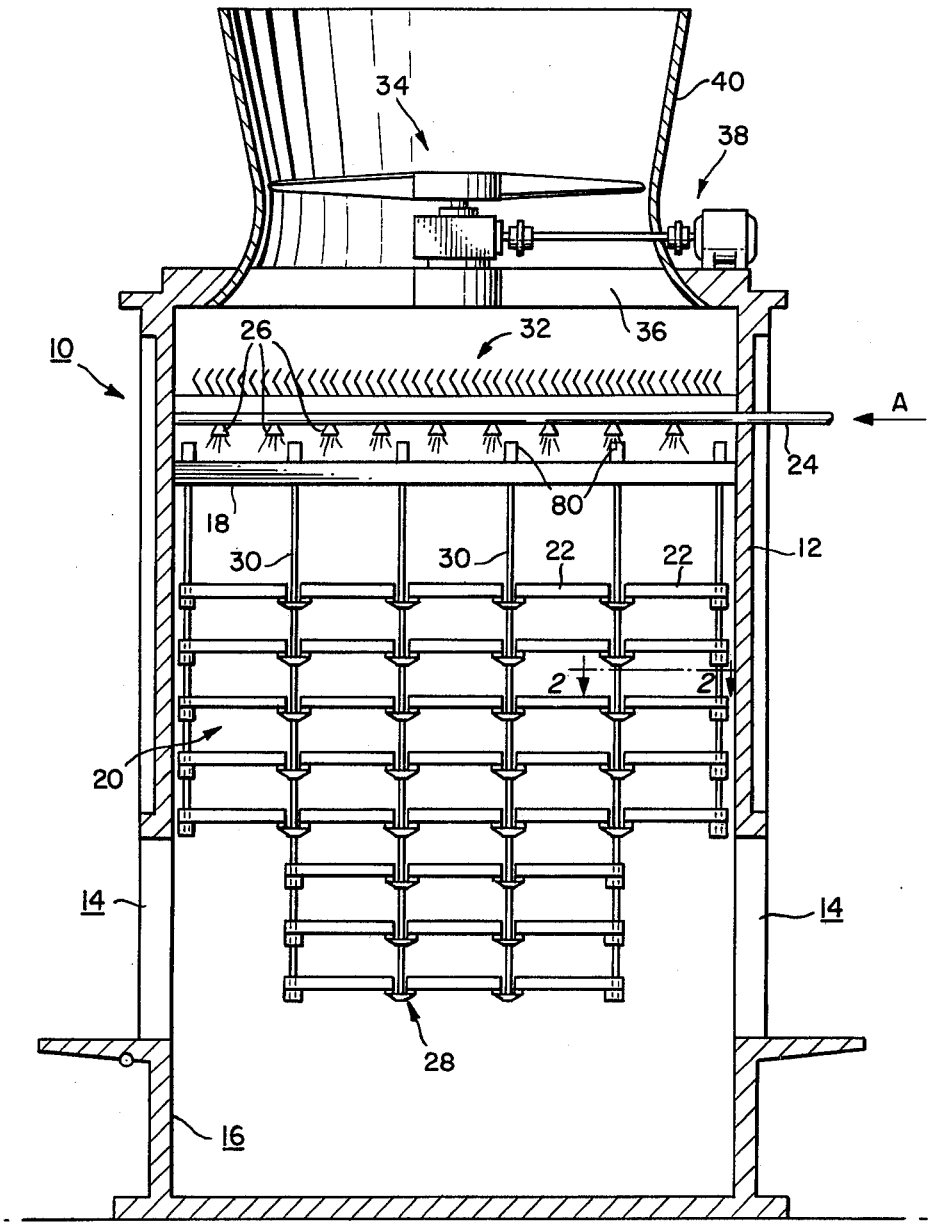
FIG. 1 is a vertical sectional view of a typical direct contact liquid/gas cooling tower.

Referring to FIG. 1 of the drawing, 10 generally designates a typical gas and liquid cooling tower comprising a housing 12 having lower gas inlet openings 14 below which is a water collecting sump or pool 16. In the upper portion of the tower is mounted a plurality of support members or beams 18 for the fill generally designated 20. The fill consists of a plurality of lattices 22 which in the illustrated form of the invention have a rectangular configuration in plan. Above the fill 20 are one or more liquid supply pipes 24 provided with a source of heated liquid from a source A not shown in the drawing. Each supply pipe is provided with a plurality of spray heads or nozzles 26 which direct the liquid to be cooled downwardly onto the fill positioned therebelow.

Each corner of the fill, as to be more fully described hereinafter, is supported on a bracket generally designated 28, which brackets are in turn supported on preferably flexible stainless steel rods or cables 30. Above the liquid supply conduits 24 is mounted, for example, conventional chevron type mist or water eliminators generally designated 32. Where the tower is of the force draft type, a fan assembly 34 is mounted on spider means 36 and driven by a motor and shaft assembly 38. The fan may be mounted in a shroud as illustrated at 40 in the drawing.

In operation of the assembly with the fan operating, air is drawn into the tower through the openings 14 generally vertically upwardly through the fill 20 which is being flooded with liquid to be cooled supplied by conduits 24 and spray nozzles 26. Droplets of the liquid to be cooled which might be entrained in the upwardly flowing air stream are removed by the eliminator 32 and essentially droplet free and heated air is expelled at the upper end of the tower.

Referring now to FIGS. 2 through 6, details of the support means for the fill 20 will be described.

Figure 2:
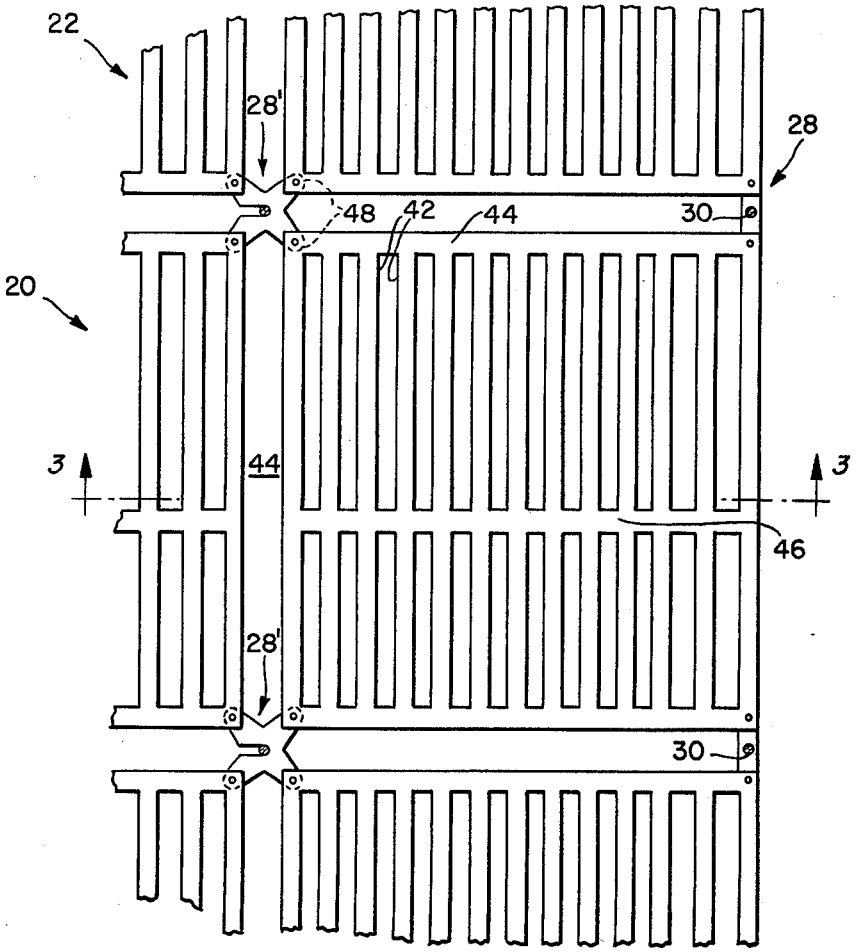
FIG. 2 is a section on line 2—2 of FIG. 1.
Figure 3:
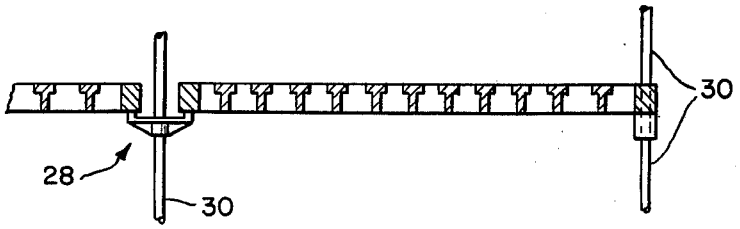
FIG. 3 is a section on line 3—3 of FIG. 2.

As shown in FIG. 2, in the illustrated form of the invention, the fill sheets 2—2 comprise rectangular frames having a plurality of slats 42 between the side elements 44. A cross rib 46 may connect a pair of the side elements 44 and as disclosed in U.S. Pat. No. 3,751,017 the cross element 46 may be off-center so that the plates when rotated present a different flow path for water and air and the sheets 22 may be molded of plastic. Each of the corners of of the sides 44 is provided with an opening 48 to receive an upstanding peg 50 FIGS. 4 and 5 of the brackets 28 and 28'.

Figure 4:
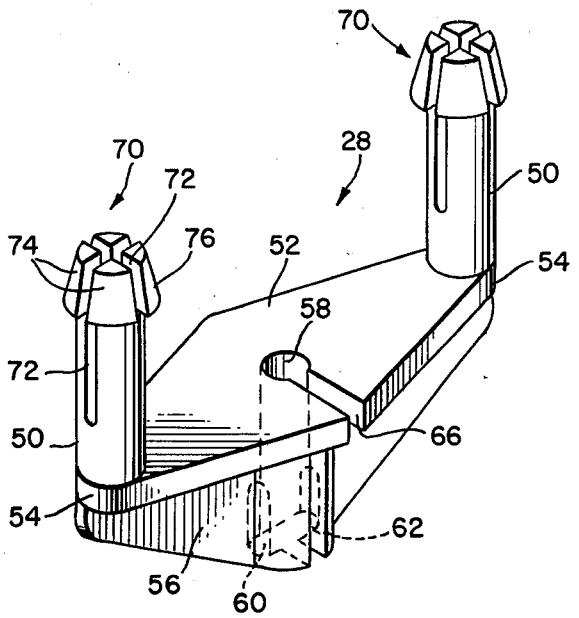
FIG. 4 is a perspective view of one form of the support bracket of the present invention.
Figures 7A, 7B, 7C, 7D, 7E:
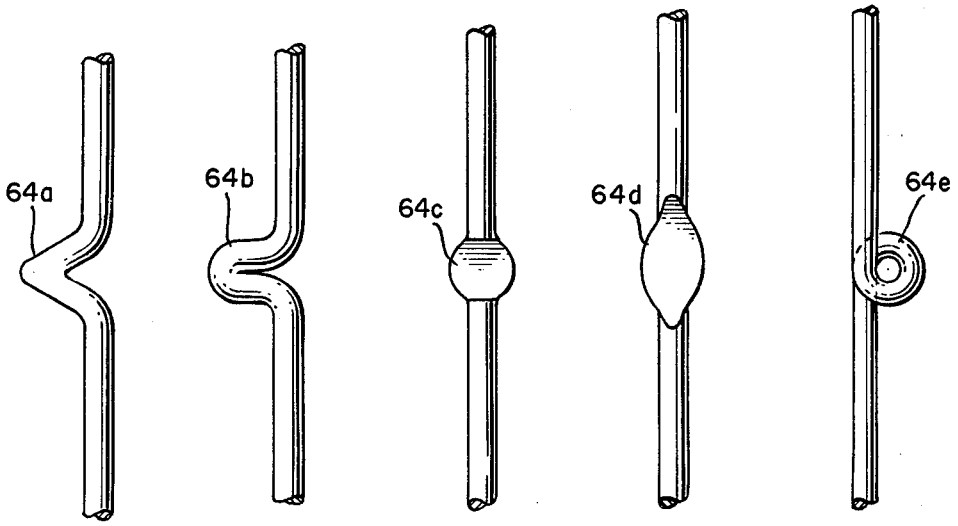
FIGS. 7*a, b, c, d* and *e* illustrate various forms of elements on a support wire for engaging and supporting its associated brackets.

Referring now particularly to FIG. 4 there is illustrated a bracket 28 having a platform portion 52 forming a pair of arms 54 which arms are integral with the pegs 50. A lower web 56 provides strength for the bracket 28 and in the web and platform 52 there is provided an opening 58 through which one of the stringer or hangar wires 30 is adapted to be threaded. The lower end of the opening 58 is provided with an enlarged recess 60 which receives one of the stop members 64*a, b, c, d, e* or the like as illustrated in FIGS. 7*a, b, c, d* and *e*. A slot 66 extends from the outer edge of the platform 52 and the web 56 to communicate with the bore 58 throughout its length whereby one of the wires 30 may be simply slipped into the opening 58 and then the entire bracket 28 slipped downwardly to nest with one of the stop or crimp elements 64*a–e* of the hangar wires.

Figure 6:
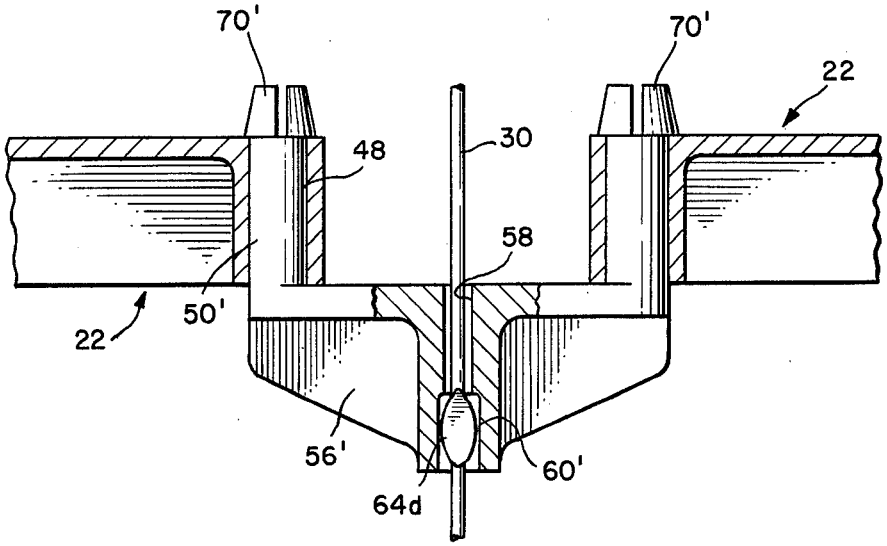
FIG. 6 is a section on line 6—6 of FIG. 5.

In order to better secure the pegs 50 in the bores 48 of each of the fill members 22 the top of each peg 50 is provided with a resilient locking tip 70 which locking tip is formed by a pair of vertical slots 72 at right angles to each other to provide four segmented portions 74 and each of the segmented portions has an enlarged tip generally designated 76 with a sloping side so that when a peg 50 is inserted in one of the openings 48, FIG. 6 of the drawing, the head portion 70 is caused to squeeze together to permit passage through the bore 48 and thereafter to re-expand to secure the pegs 50 to their respective fill sheet.

Figure 5:
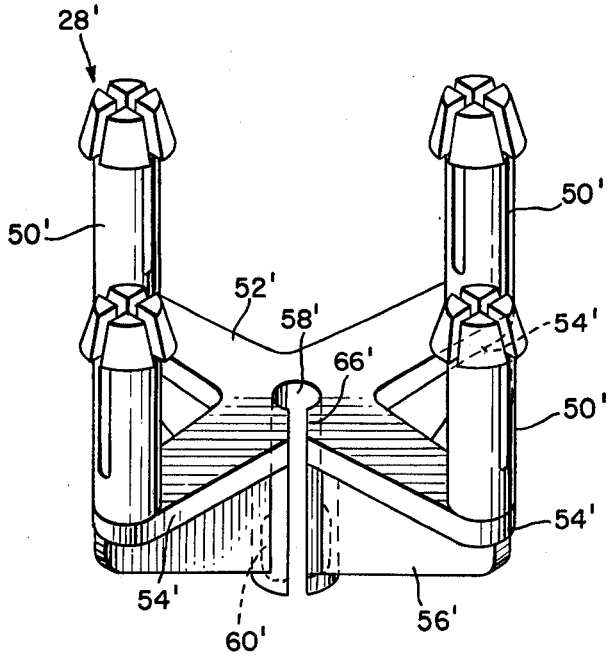
FIG. 5 is a perspective view of another form of bracket adaptable to engage four fill sheets.

Referring to FIG. 5, the bracket 28' illustrated therein is like bracket 28 except that the platform 52' has four arms 54' each provided with a peg portion 50' at its outer end. The bracket 28' is also provided with web portions 56', a bore 58', slot 66' and recesses 60'. In a preferred embodiment of the invention brackets 28 and 28' are molded from plastic such as PVC.

As hereinbefore discussed the, for example stainless steel wires 30, may be provided with various means for reception in the recesses 60–60' of the brackets 28–28' and some of such means are illustrated in FIGS. 7*a–e* wherein in FIGS. 7*a* and *b* the "crimp" is formed by providing bends 64*a* and 64*b* at the appropriate distance in the wires 30 to provide the stop means for each of the brackets 28 or 28' to maintain the proper spacing of the fill 20 FIG. 1 of the drawing. In FIG. 7*c* the stop member 64*c* is provided by crimping a bead onto the wire and in FIG. 7*d* the crimp or stop member 64*d* is provided by a flattened section of the normally circular in cross section wire 30. In FIG. 7*e* the stop member 64*e* is formed by bending the wire 30 180° to form an eyelet configuration.

In FIG. 1 there is illustrated at 80 wire retainers which by way of illustration are crimped to the upper ends of the wires after the wires 30 are passed through the openings in the support rods or beams 18.

With the bracket construction as described herein it will be seen that a broken bracket may be readily replaced without removing the wires 30 from the cooling tower by merely urging the bracket upwardly to disengage the crimp 64*a–e* from its recess 60 or 60' and slipping the wire from the bracket via the slot 66 or 66'. The bracket is then disengaged from the bores 48 in the fill 22 and a new bracket inserted and suspended on its wires 30. Similarly, one or more fill sheets 22 may be replaced by the same simple procedure without the necessity of stringing the wire through a plurality of spacers and brackets and without disconnecting the wire from its support beam at its upper end.

I claim:

1. In a liquid cooling tower construction consisting of a housing having a lower air inlet and an upper air outlet, an array of vertically stacked horizontally positioned fill sheets or grids within the housing between the lower air inlet and the upper air outlet, the improvement comprising means for supporting said array of fill sheets or grids in their vertically stacked arrangement, fill sheet or grid support bracket means having at least a pair of arms, each of the arms being provided with means engagable with a fill sheet or grid, an opening through each bracket means between the means engagable with a fill sheet or grid, each of the openings through the bracket means having at least one recess at the lower end thereof and a slot communicating with the opening and communicating with an outer wall of the bracket means, an elongate hanger member having a diameter less than the width of the slot in the bracket means and an enlarged member on the elongate hanger member receivable in the at least one recess in the bracket means.

2. The invention defined in claim 1 wherein the means engagable with a fill sheet or grid provided on each of the arms of the support bracket means comprises an upstanding peg.

3. The invention defined in claim 2 wherein each support bracket means has a pair of fill sheet or grid support arms.

4. The invention defined in claim 2 wherein each support bracket means has four arms equally spaced apart.

5. The invention defined in claim 2 wherein the elongate hangar member comprises a stainless steel wire.

6. The invention defined in claim 5 wherein the stainless steel wire is provided with crimps adapted to be received in the recess in each of said support bracket means to thereby provide stop means for the support bracket means.

* * * * *